US007159912B2

(12) United States Patent
Gerhäusser

(10) Patent No.: US 7,159,912 B2
(45) Date of Patent: Jan. 9, 2007

(54) TRANSPORT DEVICE

(75) Inventor: Kurt Gerhäusser, Darmstadt (DE)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/297,816

(22) Filed: Dec. 8, 2005

(65) Prior Publication Data

US 2006/0181096 A1 Aug. 17, 2006

(30) Foreign Application Priority Data

Dec. 10, 2004 (DE) ..... 10 2004 059 555

(51) Int. Cl.
*B66C 1/14* (2006.01)

(52) U.S. Cl. ..... 294/81.56; 294/81.2

(58) Field of Classification Search ..... 294/81.1, 294/81.2, 81.3, 81.56, 67.1, 67.3, 67.5, 74, 294/82.11, 82.12
See application file for complete search history.

(56) References Cited

U.S. PATENT DOCUMENTS 578,397 A * 3/1897 Foster ..... 294/87.1
685,315 A * 10/1901 Wiley, Jr. ..... 294/75
1,919,007 A * 7/1933 Woodruff ..... 294/68.3
2,331,566 A * 10/1943 Pautz ..... 452/189
4,831,968 A 5/1989 Anderson et al. ..... 119/102
5,037,151 A * 8/1991 Kameyama et al. ..... 294/81.55
5,342,104 A * 8/1994 Sato et al. ..... 294/74
5,476,300 A 12/1995 Dodge et al. ..... 294/81.21
5,797,639 A 8/1998 Zorzenon ..... 294/110.1

FOREIGN PATENT DOCUMENTS

GB 1 205 343 9/1970

* cited by examiner

*Primary Examiner*—Dean J. Kramer
(74) *Attorney, Agent, or Firm*—Laura C. Hargitt

(57) ABSTRACT

Transport device for an object, in particular for a pressing tool with a large weight, with a plurality of cable elements, which comprise a securing element, to which the object to be transported can be releasably fastened. According to the invention, a spreader device is provided, which is configured with a spreader weight, which is fastened to a chain hoist, which is movable in vertical direction by a drive unit, and with struts articulated to the spreader weight, wherein on the side opposite to the spreader weight each strut is fixedly connected to a cable element having the securing element on the free end.

2 Claims, 1 Drawing Sheet

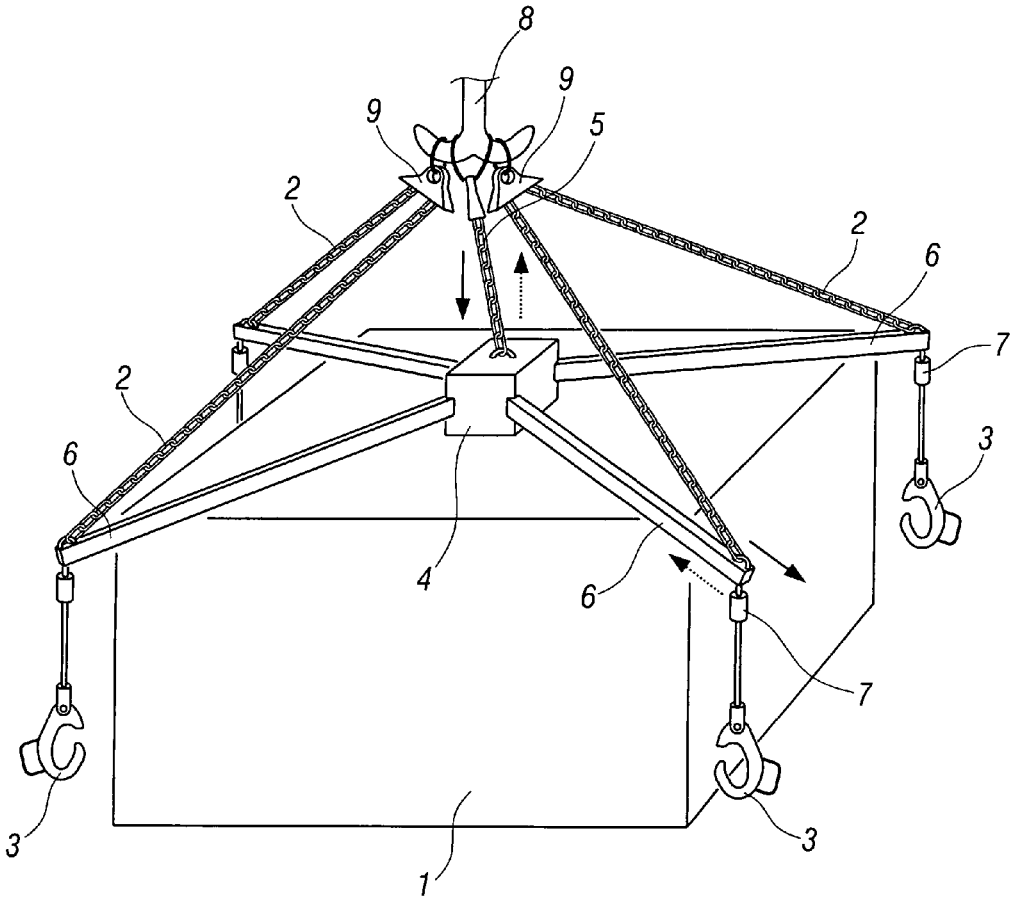
8
9
9
5
2
2
6
7
2
6
3
4
6
7
3
3
1

TRANSPORT DEVICE

TECHNICAL FIELD

The invention relates to a transport device for an object, in particular for a pressing tool with a large weight, with a plurality of cable elements, which each comprise a securing element, to which the object to be transported can be releasably fastened.

BACKGROUND OF THE INVENTION

A large number of devices for the transport (lifting, lowering, swivelling etc.) of heavy objects are known from the prior art. For example, cross beams are used, which, however, have the disadvantage of being heavy and are difficult to handle for the workman.

In addition, transport elements are known, which comprise a plurality of cable elements, which are fastened to the object to be transported by bolt connection. One of the disadvantages of these transport elements is that fastening these to the object to be transported is complicated and requires a great deal of effort and strength on the part of the workman. When fastening the cable elements to the object, the generally heavy cable elements must be brought into the correct position with respect to the object by the fitter, which at the same time involves a high assembly expense.

SUMMARY OF THE INVENTION

The object forming the basis of the invention is to provide a transport device, which avoids the mentioned disadvantages and in particular has a simple and inexpensive structure.

According to the invention, a spreader device is provided, which is configured with a spreader weight, which is fastened to a chain hoist, which is movable in vertical direction through a drive unit, and with struts articulated to the spreader weight, wherein on the side opposite to the spreader weight each strut is fixedly connected to a cable element having the securing element on the free end. The drive unit, which is driven, for example, by an electric motor, can raise and lower the spreader weight, during which a spreading force is simultaneously applied to the struts as a result of a "toggle lever function". When the spreader weight, which is preferably arranged in any possible vertical position above the free end of the struts, is moved vertically downwards, the struts, which can preferably be connected to the spreader weight via a universal joint or a ball-and-socket joint, are caused to swivel, and this causes a horizontal displacement of the cable elements. As a result, the distance between the securing element and the spreader weight can be increased by the lowering of the spreader weight, and as a result of this the distance of one securing element from the adjacent securing element is simultaneously increased.

In a preferred embodiment, the transport device has a spreader weight with four struts articulated to the spreader weight. The struts can, for example, be made of a metal, e.g. steel, or of wood. Expediently, the cable element can be a metal chain or steel cable or a cable made of a plastics material, e.g., a nylon cable.

The securing element can be configured as a hook, for example, which is hooked onto the object at a suitable location. A particular advantage is that the weight of the object to be transported is only carried by the cable elements without other structural parts, e.g., the spreader weight or the struts arranged thereon, being loaded by the weight. The device according to the invention enables the cable element ends to be spread apart, so that the fitter can fasten the securing elements to the object to be transported without any great effort. The spreader weight is then raised, wherein the horizontal distance between the respective securing element and the spreader weight is reduced. The transport device including the object, which is fastened to a double hook of a crane, for example, can then be swivelled to another location. A further advantage of the transport device according to the invention is that when objects to be transported are double stacked (on two planes), the fastening of the securing elements to the object is likewise easy to handle for a workman.

Further advantages, features and details of the invention may be seen from the following description, in which an embodiment of the invention is described in detail with reference to the drawing. In this case, the features mentioned in the claims and in the description can respectively be essential to the invention either individually or in any desired combination.

BRIEF DESCRIPTION OF THE DRAWINGS

The drawing FIGURE shows a transport device according to the invention.

DESCRIPTION OF THE PREFERRED EMBODIMENTS

The drawing FIGURE shows a transport device according to the invention for an object 1, which in the present embodiment is a heavy pressing tool 1. The transport device has four cable elements 2, which are each configured as metal chains. A securing element 3 in the form of a hook is arranged at the free end of the cable elements 2. The metal hooks 3 are fastened to the pressing tool 1 at a suitable location for the transport operation.

In addition, the transport device has a spreader weight 4, which is fastened to a chain hoist 5 movable in vertical direction by a drive unit (not shown). Four struts 6 are articulated to one another in a star shape on the spreader weight 4 made of steel. The struts 6 can be connected to the spreader weight 4, for example, via a universal joint or a ball-and-socket joint. Each strut 6 is fixedly connected on the side opposite the spreader weight 4 to a cable element 2 by means of a bolt. On the side opposite the hook 3, the chain 2 is arranged on a double hook 8 of a crane (not shown). Each cable element 2 additionally has an anti-twisting means 7 in the region of the free end of the strut 6. In the following embodiment, the anti-twisting means 7 is configured in the form of a swivel pulley. It is, of course, also possible in an alternative embodiment of the invention to use only 3 struts 6 or more than 4 struts 6.

In the shown embodiment, the electromotive chain hoist 5 is configured with a limiter for the upward and downward movement. In the region of the double hook 8, each cable element 2 is fastened to a compensating device, which comprises a rocking head 9 and a rocking link, which is not explicitly shown. The compensating device causes each cable element 2 to be loaded with an equal load during the transport operation.

The shown transport device has a weight of only about 1.7 t, a maximum spread of approximately 5 m and a minimum spread of 2.5 m. In this case, the transport device is capable of lifting pressing tools of up to 50 t, in particular of transporting same by swivel movements from one location to another location.

A downward movement of the chain hoist 5 (see arrow shown in the drawing FIGURE) causes the cable element ends to spread apart (see arrow shown in the drawing FIGURE), which means that the horizontal distance between the hooks 3 increases. When the cable hoist 5 is moved upwards with the spreader weight 4, the cable element ends and the hooks 3 are caused to move, said movement being indicated by the dotted arrow in the drawing FIGURE (contraction). In this case, the horizontal distance between the hooks 3 is reduced.

The invention claimed is:

1. A transport device for an object, with a large weight, with a plurality of cable elements, which each comprise a securing element, to which the object to be transported can be releasably fastened, characterised by a spreader device, which is configured with a spreader weight, which is fastened to a chain hoist, which is movable in vertical direction, and with struts articulated to the spreader weight, via a universal joint or ball-and-socket joint, wherein on the side opposite to the spreader weight each strut is fixedly connected to a cable element having the securing element on the free end.

2. The transport device according to claim 1, wherein the cable element has an anti-twisting means.

* * * * *